US008133077B2

(12) United States Patent
Okamoto

(10) Patent No.: US 8,133,077 B2
(45) Date of Patent: Mar. 13, 2012

(54) SHIELD CONNECTOR

(75) Inventor: Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 169 days.

(21) Appl. No.: 12/725,634

(22) Filed: Mar. 17, 2010

(65) Prior Publication Data

US 2010/0248541 A1 Sep. 30, 2010

(30) Foreign Application Priority Data

Mar. 27, 2009 (JP) ..... 2009-079488

(51) Int. Cl.
*H01R 13/648* (2006.01)

(52) U.S. Cl. ..... 439/607.54; 439/607.58

(58) Field of Classification Search ..... 439/607.54, 439/607.58, 607.35, 607.4, 736; 29/883
See application file for complete search history.

(56) References Cited

U.S. PATENT DOCUMENTS

| | | | | |
|---|---|---|---|---|
| 3,744,128 | A * | 7/1973 | Fisher et al. | 29/858 |
| 4,433,206 | A * | 2/1984 | Lewis | 174/359 |
| 4,497,533 | A * | 2/1985 | Genova et al. | 439/88 |
| 4,597,624 | A * | 7/1986 | Lax et al. | 439/607.47 |
| 4,634,208 | A * | 1/1987 | Hall et al. | 439/607.51 |
| 4,650,270 | A | 3/1987 | Tajima et al. | |
| 4,678,260 | A | 7/1987 | Gallusser et al. | |
| 4,830,629 | A * | 5/1989 | Yoshimura | 439/607.41 |
| 4,846,724 | A * | 7/1989 | Sasaki et al. | 439/607.41 |
| 4,854,890 | A * | 8/1989 | Nishimura | 439/607.35 |
| 4,886,463 | A * | 12/1989 | Scott et al. | 439/89 |
| 5,938,473 | A * | 8/1999 | Nishio et al. | 439/567 |
| 6,315,608 | B1 | 11/2001 | Lopata et al. | |
| 6,722,927 | B1 | 4/2004 | Eriksen et al. | |
| 7,341,487 | B2 * | 3/2008 | Wu | 439/607.51 |
| 7,841,910 | B2 * | 11/2010 | Fields et al. | 439/680 |
| 2008/0009189 | A1 | 1/2008 | Wu | |

FOREIGN PATENT DOCUMENTS

| | | |
|---|---|---|
| JP | 2006-196198 | 7/2006 |

* cited by examiner

*Primary Examiner* — Neil Abrams
(74) *Attorney, Agent, or Firm* — Gerald E. Hespos; Michael J. Porco

(57) ABSTRACT

A shield connector (C) includes a tubular metallic shield shell (30) integrally attached to the outer circumferential surface of a housing (10) made of resin by insert molding. The shield shell (30) is formed with a cut (32) extending between opposite ends in a longitudinal direction, and a pair of opening preventing pieces (34A, 34B) which extend radially inward or outward, circumferentially face each other and can come into contact with each other when edges (33A, 33B) at the opposite sides of the cut (32) are displaced in directions away from each other are provided on the opposite edges (33A, 33B) of the shield shell 30 facing each other with the cut (32) therebetween.

15 Claims, 10 Drawing Sheets

SHIELD CONNECTOR

BACKGROUND OF THE INVENTION

1. Field of the Invention

The invention relates to a shield connector.

2. Description of the Related Art

Japanese Unexamined Patent Publication No. 2006-196198 discloses a shield connector with a tubular metallic shield shell integrally attached to the outer peripheral surface of a resin housing by insert molding. A shield member of a mating shield connector is connected with the outer peripheral surface of the shield shell.

The above-described shield connector is produced by swaging a shield shell into a tubular form, setting the shield shell in a mold and then pouring resin into the mold. The mold is set to have a slightly larger size in anticipation of a contraction of the resin during insert molding. However, the swaged tubular shield shell is difficult to deform inwardly following the contraction of the resin. Thus, dimensional accuracy of the housing has been difficult to ensure.

The invention was developed in view of the above situation and an object thereof is to increase the dimensional accuracy of a housing of a shield connector.

SUMMARY OF THE INVENTION

The invention relates to a shield connector with a tubular metallic shield shell attached integrally to the outer peripheral surface of a resin housing by insert molding. The shield shell has at least one cut extending longitudinally between opposite ends. Two opening preventing pieces are provided at opposite edge portions of the shield shell facing each other with the cut therebetween. The opening preventing pieces extend radially outward or inward and circumferentially face each other. The opening preventing pieces can contact each other when edge portions at the substantially opposite sides of the cut are displaced in directions away from each other.

The shield shell is deformed easily to reduce its diameter following the contraction of the housing during insert molding. Thus, the dimensional accuracy of the housing can be increased. Further, the opening preventing pieces contact to prevent opening of the shield shell.

The opening preventing piece may be at a position of the edge portion circumferentially projecting from the other part. Accordingly, the opposite edge portions facing each other with the cut therebetween are separated with the pair of opening preventing pieces held in contact, and the shield shell is deformed to reduce its diameter while narrowing the width of the cut of the shield shell as the housing contracts during insert molding. Thus, the opposite edge portions of the cut are not likely to contact when the shield shell is deformed to reduce its diameter, and a smooth deformation can be realized.

The opening preventing pieces may be embedded entirely in the housing. According to such a construction, the opening preventing pieces are held in the housing so that the shield shell cannot detach from the housing.

The housing may include at least one rib projecting radially outward along the cut of the shield shell.

The opening preventing pieces may be bent to stand out from bulges. Extending distances of the opening preventing pieces from the bulges may be shorter than the projecting distance of the rib, so that the opening preventing pieces are embedded entirely in the rib.

The opening preventing pieces may circumferentially face each other, and parts of both opening preventing pieces projecting forward or backward from the bulges may substantially face parts of the facing opening preventing pieces coupled to the bulges.

The bulges may be displaced slightly in forward and backward directions substantially in the center of the shield shell in longitudinal direction. Bulging distances of the bulges may be slightly less than the width of the rib.

The opening preventing pieces may be shaped and sized substantially identically and may define substantially rectangular plates longer in longitudinal direction. The widths of both opening preventing pieces in the longitudinal direction preferably equal the widths of escaping recesses in the same direction and may be wider than the widths of the bulges in the same direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
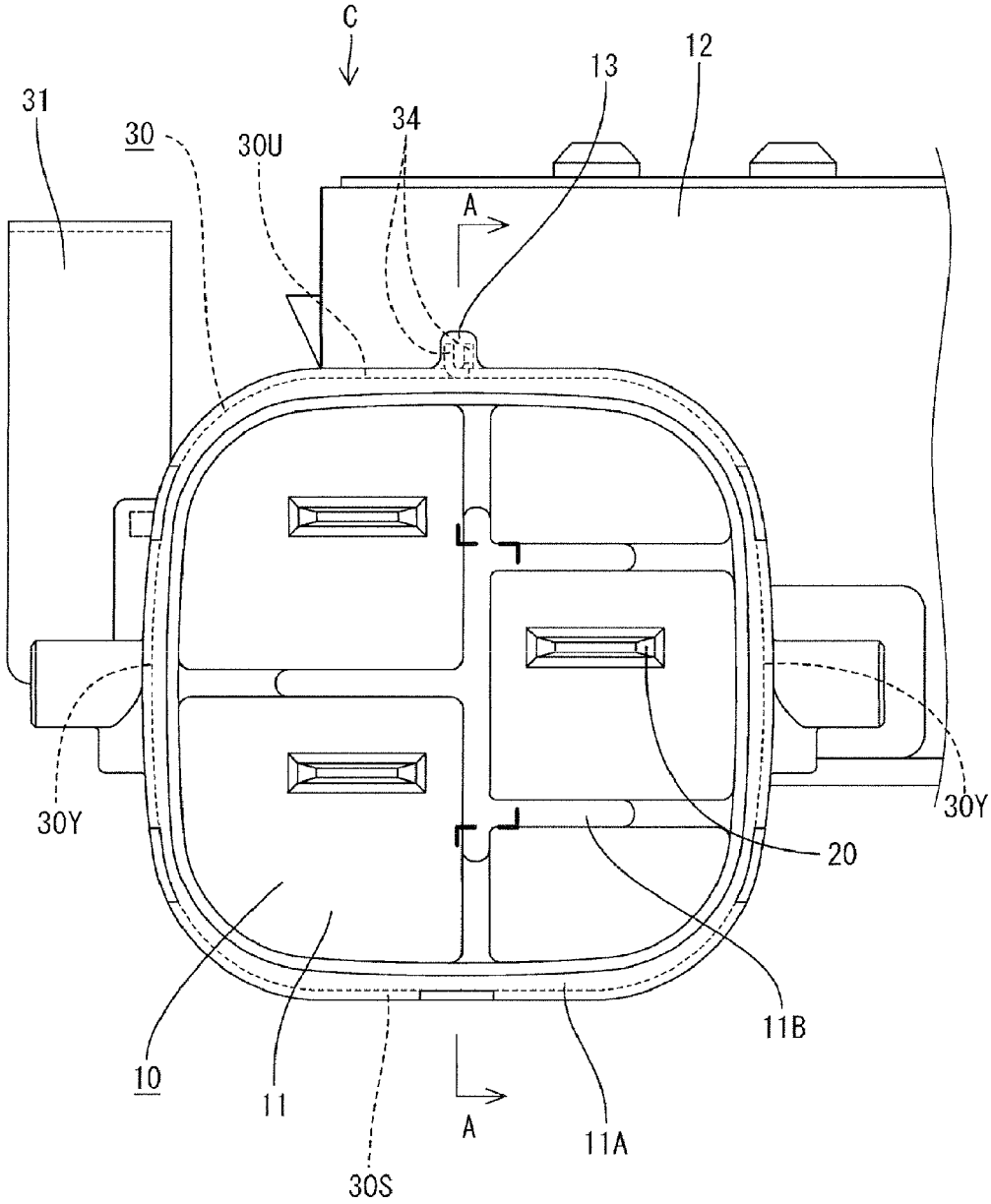
FIG. 1 is front view partly in section of a shield connector according to one embodiment
Figure 2:
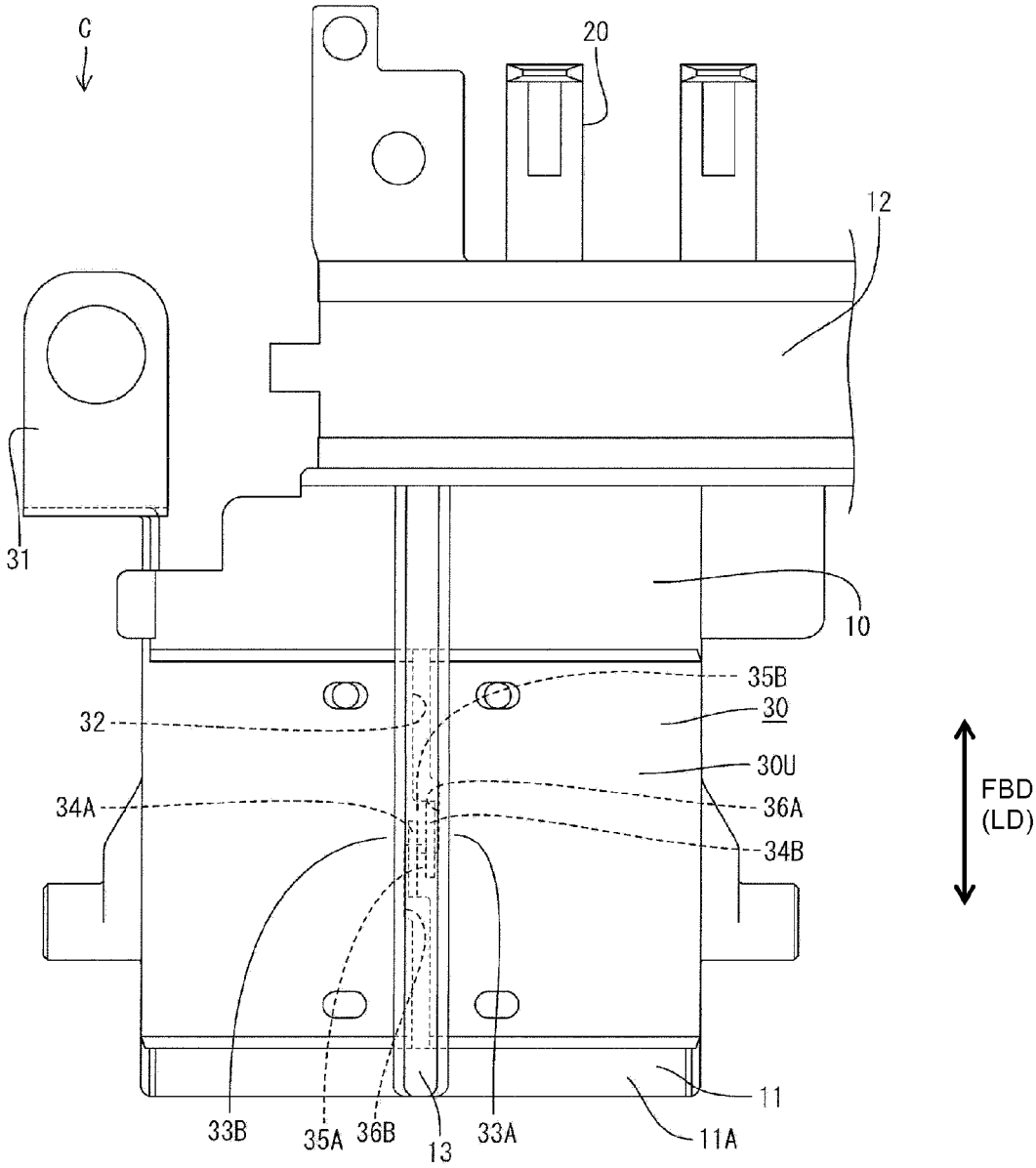
FIG. 2 is a plan view of the shield connector.
Figure 3:
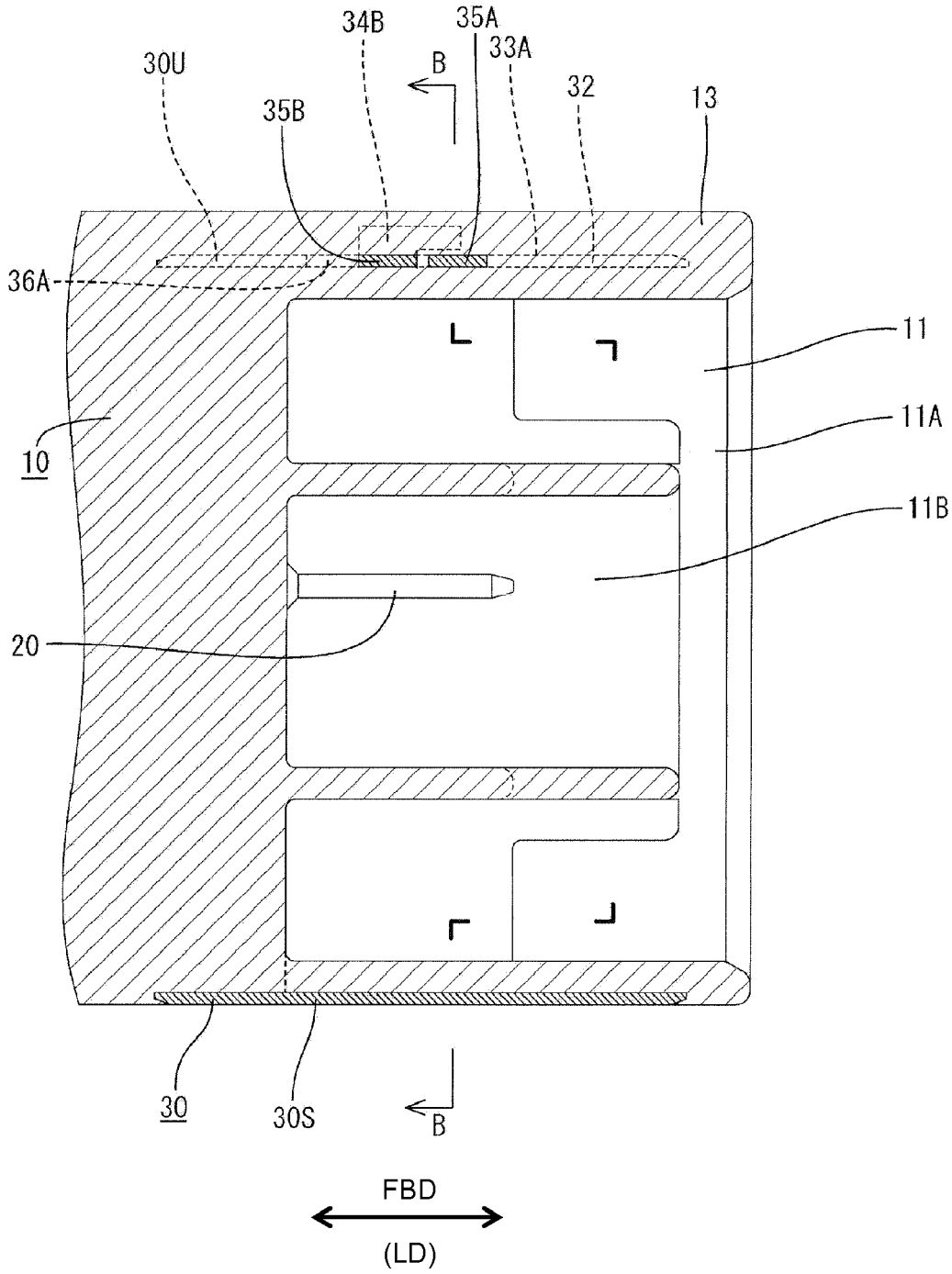
FIG. 3 is a section along A-A of FIG. 1.

A shield connector in accordance with the invention is identified generally by the letter C and is configured to be mounted on a shield case (not shown) of a device, such as a motor of an electric car, and connected electrically to the device (not shown). In the following description, an end (lower end in FIG. 2) of each constituent element to be connected with an unillustrated mating connector is referred to as the front, and upper and lower ends of FIG. 1 are referred to as upper and lower ends.

The shield connector C is provided with a housing 10 made e.g. of synthetic resin, terminals 20 and a shield shell 30.

The housing 10 includes a fittable portion 11 configured to fit to the mating connector and at least one connector fixing portion 12 to be fixed to the shield case. The fittable portion 11 projects substantially forward from the connector fixing portion 12. The fittable portion 11 includes a forwardly open tube 11A and a partition 11B projecting forward in the tube 11A. As shown in FIG. 1, the tube 11A has a substantially square shape when viewed from the front, and the partition 11B is disposed to cross the interior of the tube 11A substantially vertically and horizontally, thereby partitioning the tube 11A into a plurality of sections.

Three terminals 20 are held in the housing 10 and can connect the device electrically with the mating connector. The three terminals 20 are held integrally in the housing 10 by insert molding. One end of each terminal 20 projects forward in the fittable portion 11 and the other end projects up from the lateral upper surface of the connector fixing portion 12. The three terminals 20 are arranged so that one end of each terminal 20 projects in a corresponding one of the sections partitioned by the partitioning portion 11B in the tube 11A.

A rib 13 projects up and out from the upper surface of the fittable portion 11 of the housing 10. The rib 13 extends substantially straight in forward and backward directions FBD at a substantially widthwise center position of the fittable portion 11 (see FIG. 2). A projecting distance of the rib 13 is substantially equal to the thickness of the tubular portion 11A, and the length of the rib 13 in forward and backward directions FBD is set to extend over the entire length of the fittable portion 11 in forward and backward directions FBD.

The metallic shield shell 30 is attached integrally to the outer peripheral surface of the housing 10 by insert molding. The shield shell 30 has a substantially tubular shape substantially in conformity with the outer shape of the fittable portion 11 and substantially entirely covers the outer peripheral surface of the housing 10. When viewed from front, the shield shell 30 has a substantially square shape with four substantially arcuate corners. An end of an unillustrated shield member shielding the mating connector is connected electrically with the outer peripheral surface of the shield shell 30. The shield shell 30 has a fixing portion 31 to be fixed to the shield case of the device e.g. by an unillustrated screw. The shield shell 30 includes lateral sides 30Y covering the opposite side surfaces of the fittable portion 11, an upper side 30U covering the upper surface of the fittable portion 11 and a lower side 30S covering the lower surface of the fittable portion 11.

A cut 32 extends between opposite ends of the shield shell 30 in a longitudinal direction LD (forward and backward directions FBD) to cut the shield shell 30 at one circumferential position.

The cut 32 of the shield shell 30 extends substantially straight in forward and backward directions FBD at a substantially widthwise center position of the upper side 30U. Thus, the cut 32 extends substantially along the rib 13 of the housing 10 and outer and inner sides of the cut 32 are covered by resin.

First and second edges 33A and 33B are formed respectively at the right and left edges of the cut 32 of the shield shell 30 and substantially facing each other with the cut 32 therebetween. A first opening preventing piece 34A is formed on the first edge 33A and a second opening preventing piece 34B is formed on the second edge 33B. The opening preventing pieces 34A and 34B can contact each other when the opposite edges 33A, 33B are displaced away from each other.

The first and second opening preventing pieces 34A, 34B are provided respectively at leading ends of first and second bulges 35A and 35B that bulge circumferentially out from the respective first and second edges 33A, 33B. The bulges 35A, 35B are displaced slightly from one another in forward and backward directions FBD relative to the center of the shield shell 30 in forward and backward directions FBD. Bulging distances of the bulges 35A, 35B are slightly shorter than the width of the rib 13.

First and second escaping recesses 36A and 36B are formed in the first and second edges 33A, 33B at positions adjacent the first and second bulges 35A, 35B and are displaced from one another in forward and backward directions FBD. The first escaping recess 36A is formed behind the first bulge 35A and the second escaping recess 36B is formed before the second bulge 35B. Additionally, the first escaping recess 36A faces the second bulge 35B and the second escaping recess 36B faces the first bulge 35A. The dimension of each escaping recess 36A, 36B in forward and backward directions FBD exceeds the corresponding dimension of the bulges 35*a*, 35B, preferably by a factor of two.

The first and second opening preventing pieces 34A, 34B are bent to stand up and out from the leading ends of the first and second bulges 35A, 35B. The first and second opening preventing pieces 34A, 34B define substantially identical rectangular plates that are long in forward and backward directions FBD. The dimensions of the opening preventing pieces 34A, 34B in the longitudinal direction LD substantially equal the dimensions of the escaping recesses 36 in the same direction and exceed the corresponding dimensions of the bulges 35, preferably by a factor of two. Extending distances of the opening preventing pieces 34A, 34B from the bulges 35 are less than the projecting distance of the rib 13, so that the opening preventing pieces 34A, 34B are embedded entirely in the rib 13.

The front end of the first opening preventing piece 34A in the longitudinal direction LD is coupled to the first bulge 35A, and the rear end of the first opening preventing piece 34A projects rearward from the first bulge 35A. Conversely, the rear end of the second opening preventing piece 34B is coupled to the second bulge 35B and the front end of the second opening preventing piece 34B projects forward from the second bulge 35B. Thus, the first and second opening preventing pieces 35A, 35B project in substantially opposite forward and backward directions FBD.

The first and second opening preventing pieces 34A, 34B face one another across the cut 32. More particularly, parts of the opening preventing pieces 34A, 34B that project forward or backward from the respective bulge 35A, 35B face parts of the opposed opening preventing piece 34B, 34A coupled to the opposed bulge 35B, 35A.

Figure 4:
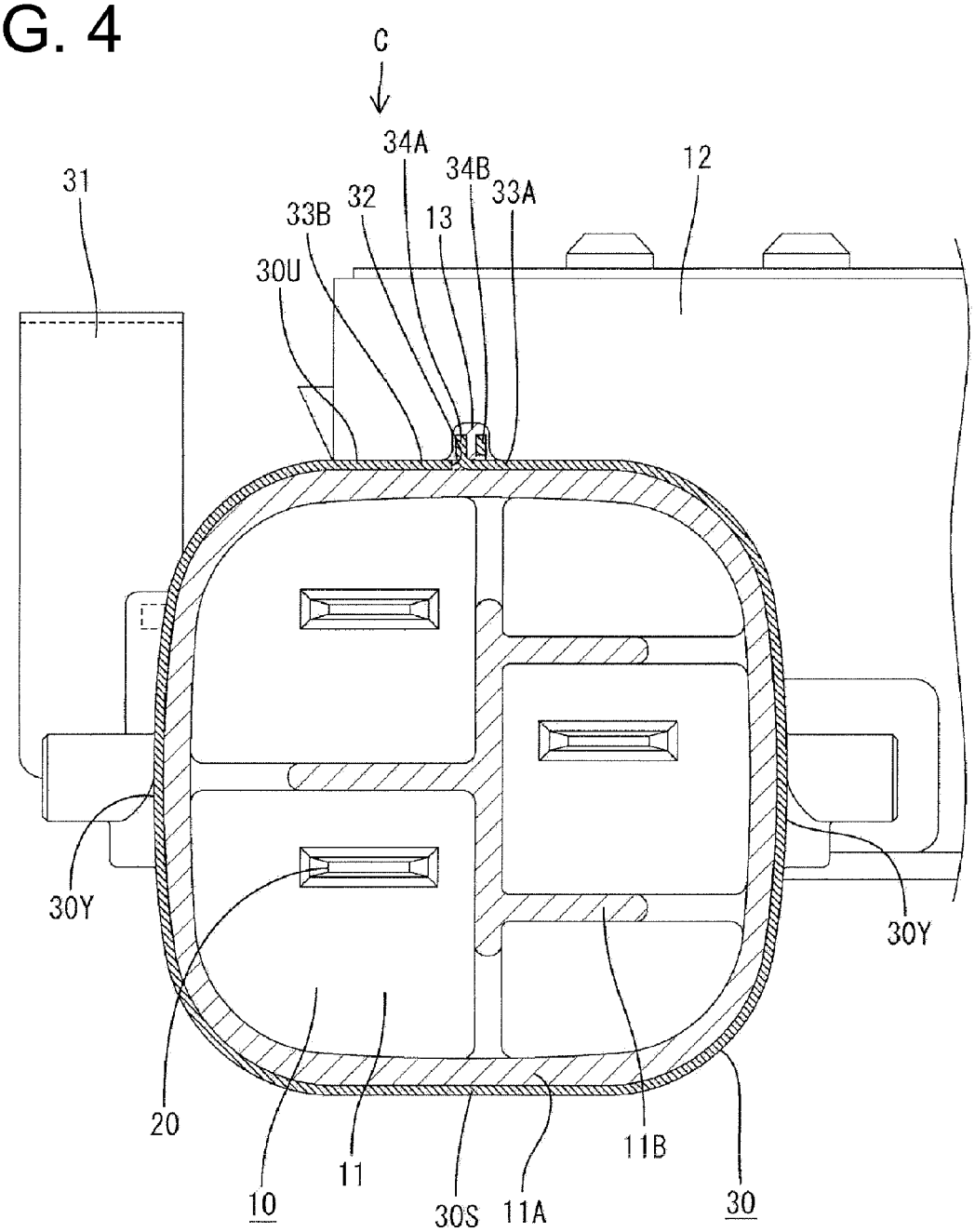
FIG. 4 is a section along B-B of FIG. 3.
Figure 5:
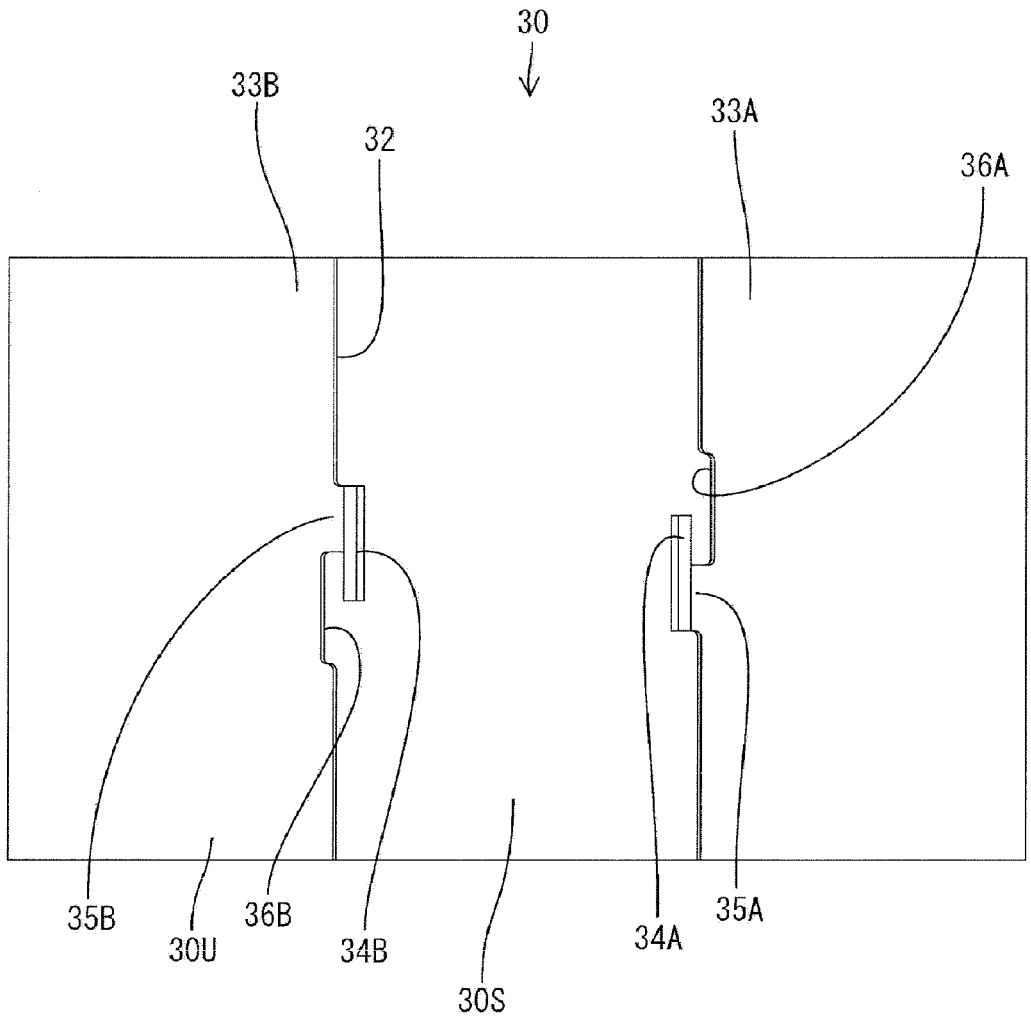
FIG. 5 is a schematic plan view showing a state before a first opening preventing piece and a second opening preventing piece of a shield shell are brought into contact.
Figure 6:
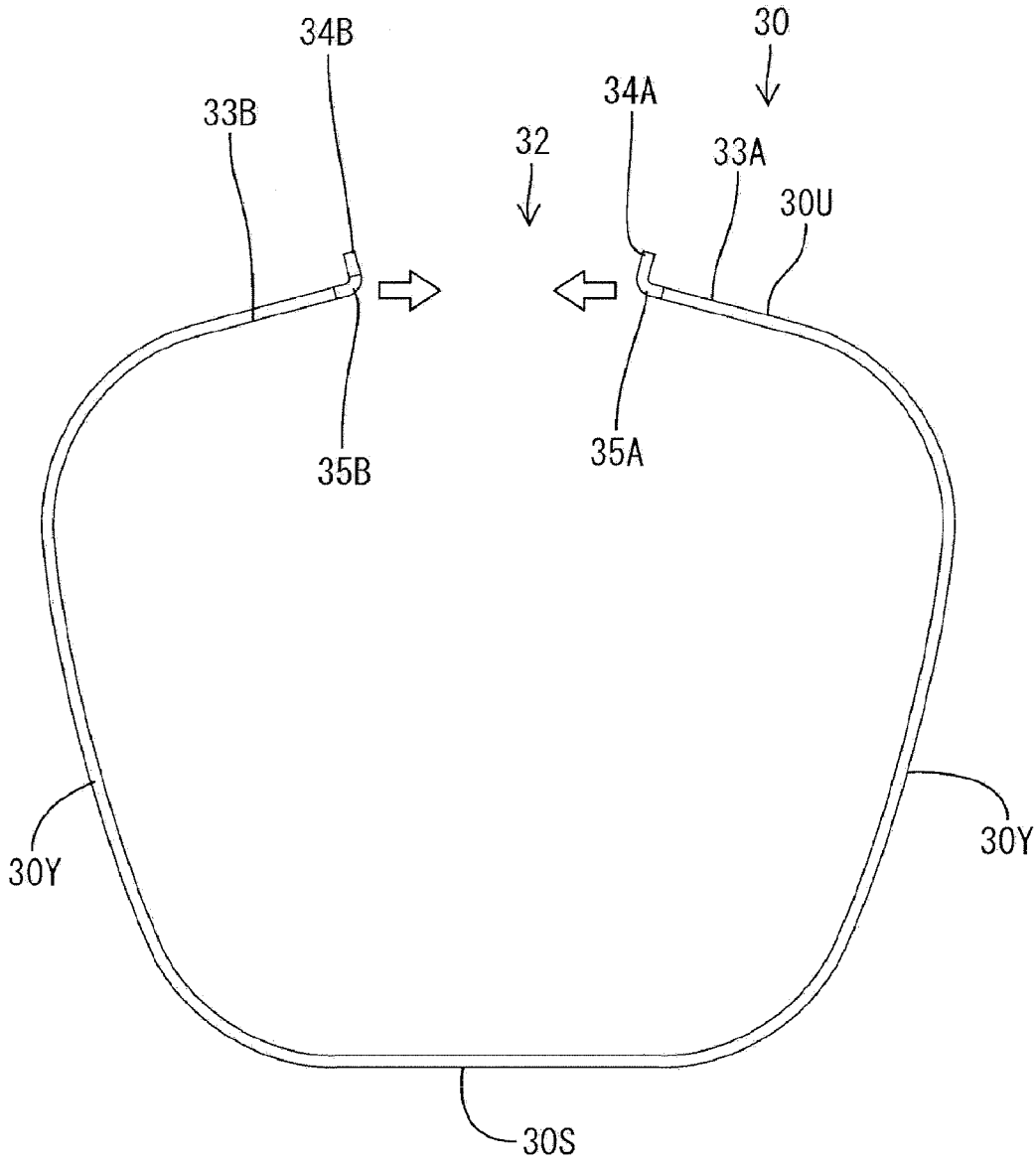
FIG. 6 is a schematic front view showing the state of FIG. 5.
Figure 7:
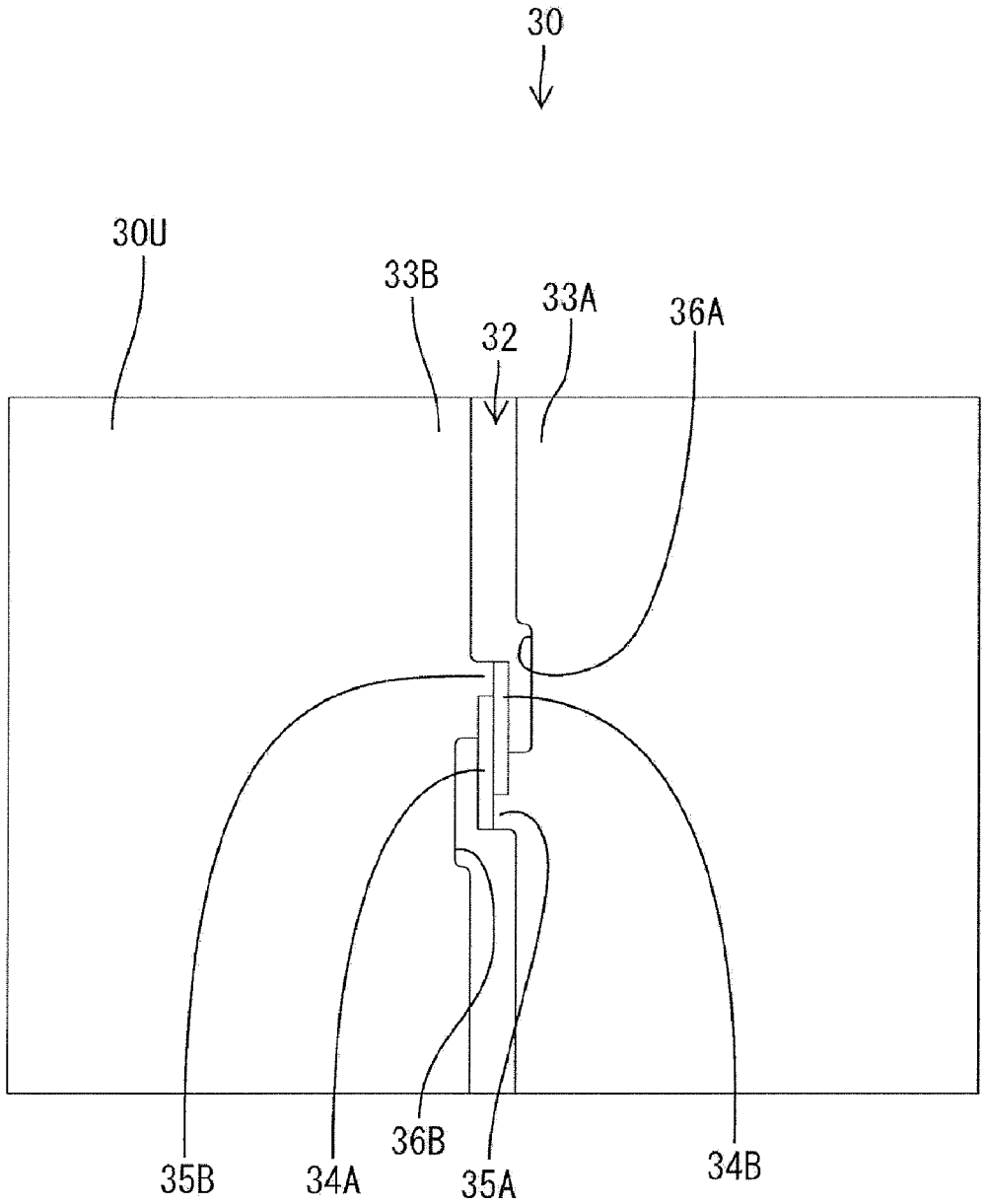
FIG. 7 is a schematic plan view showing a state where the first and second opening preventing pieces of the shield shell are held in contact.

The housing 10 is molded by upper and lower molds 40U and 40S, as shown in FIG. 4. The upper and lower molds 40U, 40S are opened in a vertical direction that is substantially orthogonal to the longitudinal direction LD of the shield shell 30. The molds 40U, 40L have a slightly larger size, assuming a contraction amount of resin during insert molding. A boundary surface between the upper and lower molds 40U, 40S is located substantially in the vertical center of the shield shell 30.

Figure 8:
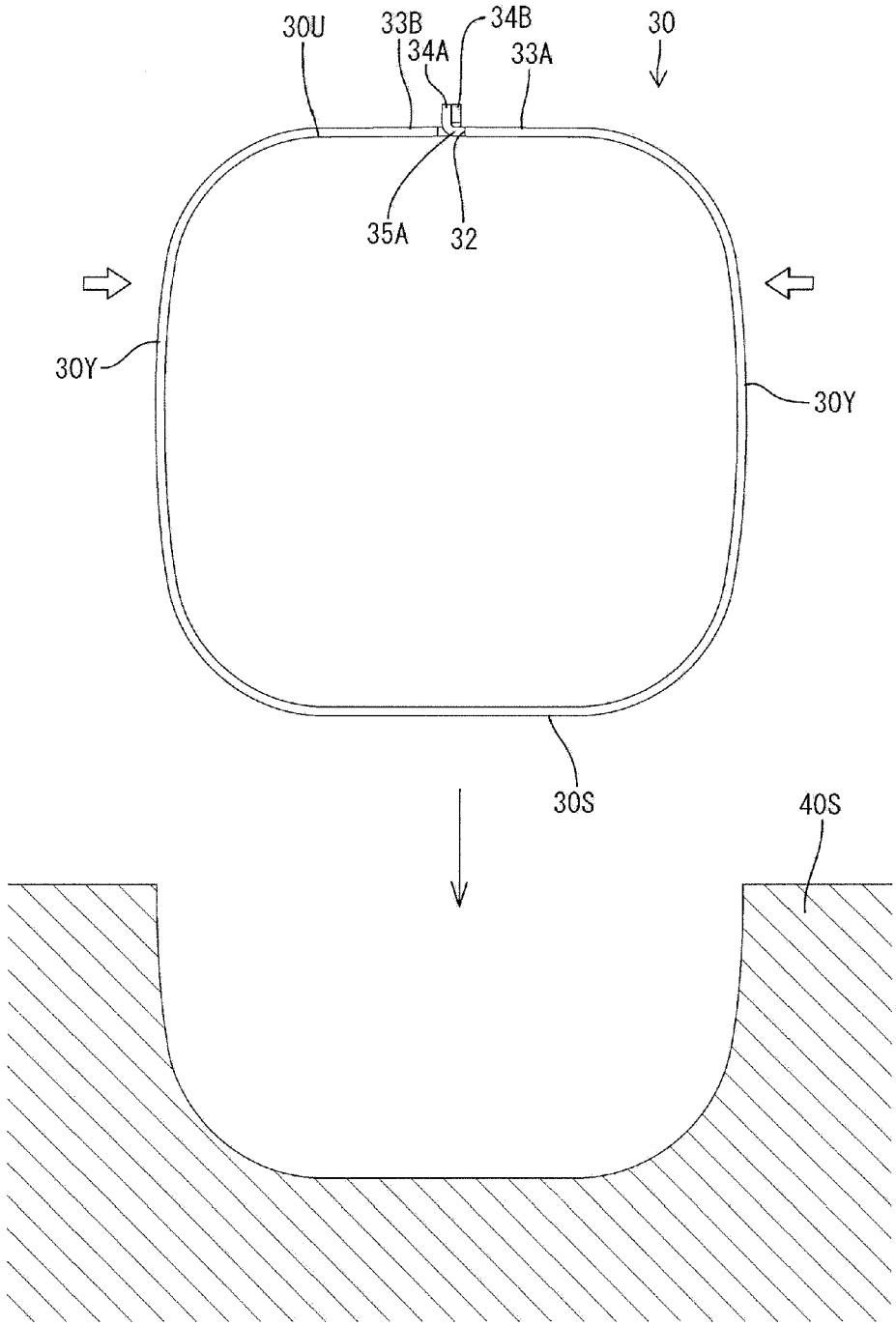
FIG. 8 is a schematic diagram showing a state where the shield shell is set in a lower mold.
Figure 9:
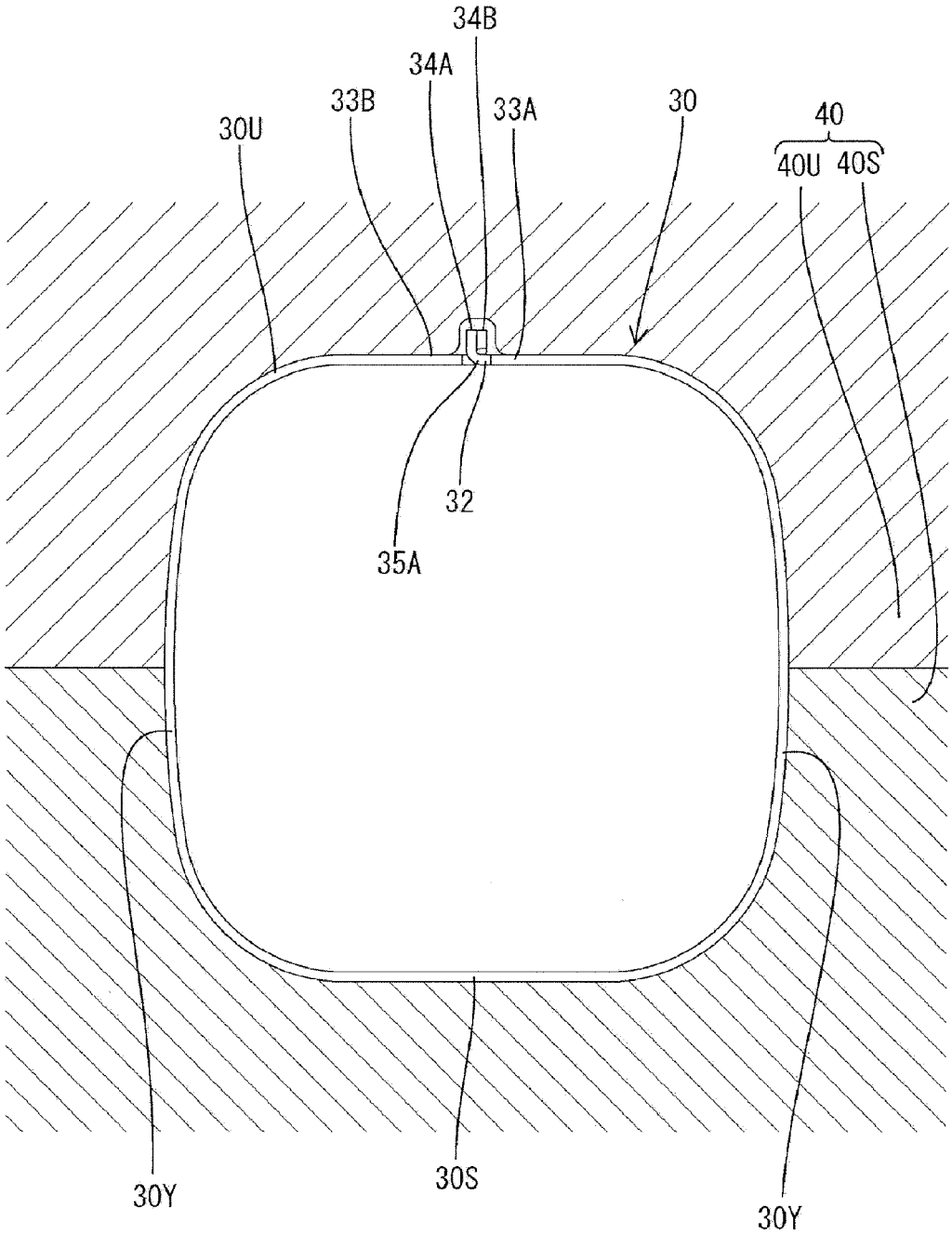
FIG. 9 is a schematic diagram showing a state where the shield shell is set in a mold.

The shield shell 30 is pressed inwardly by fingers from left and right sides and deformed sufficiently for the first and second opening preventing pieces 34A, 34B to be held in contact. At this time, the width of the cut 32 equals the bulging distances of the bulges 35. The shield shell 30 then is set in the lower mold 40S, as shown in FIG. 8.

Figure 10:
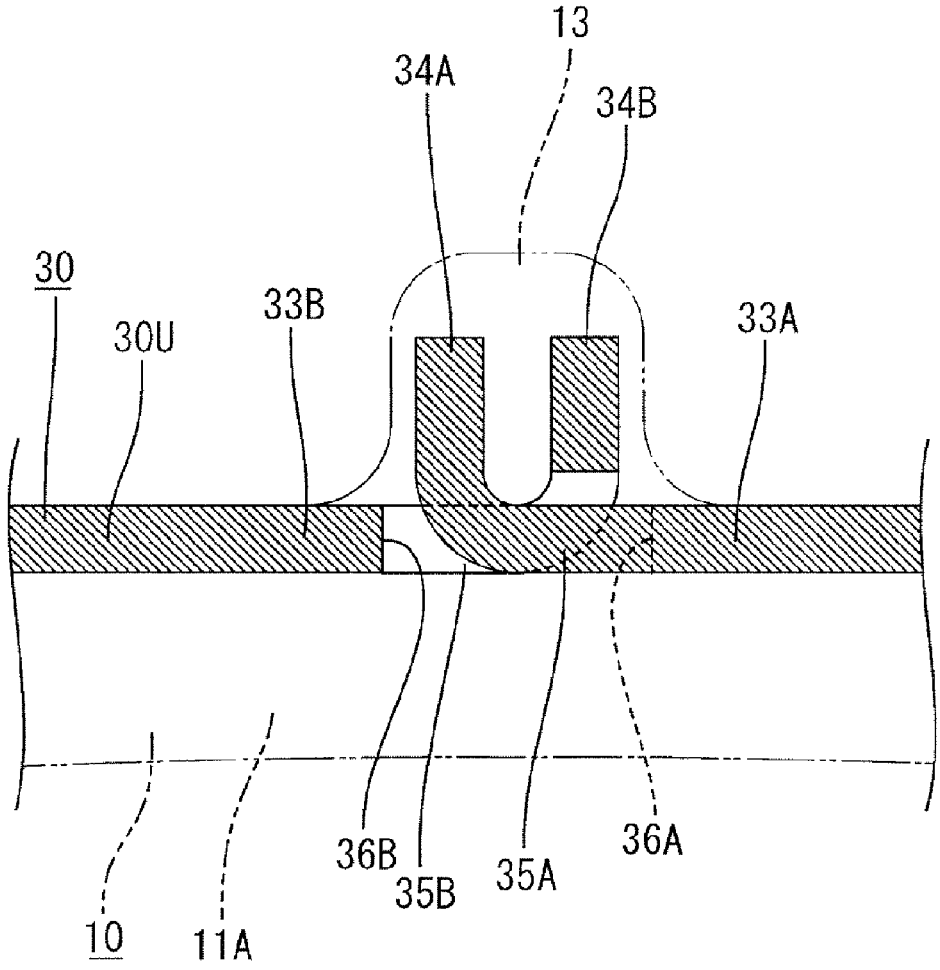
FIG. 10 is a partial enlarged schematic diagram showing a state where the shield shell is deformed to reduce its diameter.

The terminals 20 are set at specified positions after the shield shell 30 is set in the lower mold 40S and the upper mold 40U then is moved down to close the molds. Molten resin is injected and filled into the closed molds 40U, 40L, and then is cooled and solidified, thereby causing the resin to contract. As a result, the shield shell 30 deforms inwardly and narrows the cut 32. Accordingly, the first and second opening preventing pieces 35A, 35B that were held in contact are separated and the first and second bulges 35A, 35B are displaced to fit at least partly into the escaping recesses 36B, 36A without interfering with the facing edges 33 (see FIG. 10).

The resin and the shield shell 30 contract by assumed contraction amounts so that the fittable portion 11 of the housing 10, including the shield shell 30, has specified outer dimensions. In this way, the production of the shield connector C including the shield shell 30 integral or unitary to the outer circumferential surface of the housing 10 is completed.

The shield shell 30 is formed with the cut 32 extending between the opposite front and rear ends, and the first and second edges 33A, 33B of the shield shell 30 face each other with the cut 32 therebetween. The opening preventing pieces 34A, 34B extend out and up to face each other circumferentially and can contact each other when the opposite edges 33A, 33B are displaced away from each other.

The cut 32 enables the shield shell 30 to be deformed easily and predictably following contraction of the resin during insert molding. Thus, dimensional accuracy of the housing 10 is increased. Further, the first and second edges 33A, 33B of the shield shell 30 are provided with the first and second opening preventing pieces 34A, 34B. If a shield shell is formed only with a cut and no opening preventing pieces, there is a possibility that the cut of the shield shell will open. Such a shield shell could deform to increase its diameter and could come out from the lower mold 40S after hand pressure is released. However, the first and second opening preventing pieces 34A, 34B of the above-described preferred embodiment prevent the shield shell 30 from opening and separating from the lower 40S.

The first and second opening preventing pieces 34A, 34B project circumferentially from the first and second edges 33A, 33B beyond the other parts of the shield shell 30. Thus, the opening preventing pieces 34A, 34B can contact to keep the first and second edges 33A, 33B separated while permitting the width of the cut 32 of the shield shell 30 to narrow and to reduce the diameter of the shield shell 30 as the housing 10 contracts during insert molding. The first and second edges 33A, 33B are not likely to come into contact with each other when the shield shell 30 is deformed inwardly, thereby ensuring smooth deformation.

The first and second opening preventing pieces 34A, 34B are embedded entirely in the housing 10. Therefore the shield shell 30 is held reliably in a closed state. As a result, the shield shell 30 cannot be deformed outwardly and detached from the housing 10.

The present invention is not limited to the above described and illustrated embodiment. For example, the following embodiments are also included in the technical scope of the present invention.

The first and second opening preventing pieces 34A, 34B project up and out from the leading ends of the first and second bulges 35A, 35B in the above embodiment. However, they may hang down and in from the bulges.

The first and second bulging portions 35A, 35B circumferentially project from the other parts of the first and second edges 33A, 33B in the above embodiment. However, the first and second bulges may be bent circumferentially after projecting out or in from the first and second edges.

The opening preventing pieces 34A, 34B are substantially in the center of the shield shell 30 in forward and backward directions FBD in the above embodiment. However, the positions and number of opening preventing pieces can be changed without departing from the scope of the invention.

The first and second opening preventing pieces 34A, 34B project circumferentially from the first and second edges 33A, 33B in the above embodiment. However, only one of them may project circumferentially.

What is claimed is:

1. A shield connector (C) comprising:

a housing (10) made of resin and having an outer peripheral surface; and a tubular metallic shield shell (30) integrally attached to the outer peripheral surface of the housing (10) by insert molding, the shield shell (30) having opposite ends spaced apart in a longitudinal direction (LD) and a cut (32) extending between the opposite ends, first and second edges (33A, 33B) at opposite sides of the cut (32), first and second opening preventing pieces (34A, 34B) extending out or in from the respective first and second edges (33A, 33B) and at least partly facing one another, the first and second opening preventing pieces (34A, 34B) being engageable with one another to limit displacement of the edges (33A, 33B) away from one another and the first and second opening preventing pieces (34A, 34B) being engageable respectively with the second and first edges (33B, 33A) to limit displacement of the edges (33B, 33A) toward one another.

2. The shield connector of claim 1, wherein portions of the first and second opening preventing pieces (34A, 34B) project toward the respective second and first edges (33B, 33A).

3. The shield connector of claim 1, wherein the opening preventing pieces (34A, 33B) are embedded entirely in the housing (10).

4. The shield connector of claim 1, wherein the housing (10) includes at least one rib (13) projecting outward along the cut (32) of the shield shell (30).

5. The shield connector of claim 4, further comprising a first bulge (35A) projecting from the first edge (33A) toward the second edge (33B) and a second bulge (35B) projecting from the second edge (33B) toward the first edge (33A), the first and second opening preventing pieces (34A, 34B) being bent to stand out from the respective first and second bulges (35A, 35B), extending distances of the opening preventing pieces (34A, 34B) from the bulges (35) being less than a projecting distance of the rib (13), so that the opening preventing pieces (34A, 34B) are embedded entirely in the rib (13).

6. The shield connector of claim 5, wherein the opening preventing pieces (34A, 34B) substantially entirely face each other at opposite sides of the cut (32), the first opening preventing piece (34A, 34B) having a portion projecting back from the first bulge (35A) and being opposed to the second bulge (35B) and the second opening preventing piece (34B) having a portion projecting forward from the second bulge (35B) and being opposed to the first bulge (35A).

7. The shield connector of claim 6, wherein the bulges (35A, 35B) are displaced in forward and backward directions (FBD) from a center of the shield shell (30) in a longitudinal direction (LD), and bulging distances of the bulges (35A, 35B) are slightly shorter than a width of the rib (13).

8. The shield connector of claim 1, wherein each of the edges (33A, 33B) has an escaping recess (36A, 36B), the opening preventing pieces (34A, 34B) being substantially identical rectangular plates longer in the longitudinal direction (LD), dimensions of the opening preventing pieces (34A, 34B) in the longitudinal direction (LD) being substantially equal to the dimensions of the escaping recesses (36) in the longitudinal direction (LD) and being greater than dimensions of the bulges (35) in the longitudinal direction (LD).

9. The shield connector of claim 1, wherein the housing (10) includes at least one rib (13) projecting outward along the cut (32) of the shield shell (30), the opening preventing pieces (34A, 33B) being embedded entirely in the rib (13).

10. A shield connector (C) comprising:

a housing (10) made of resin and having an outer peripheral surface; and a tubular metallic shield shell (30) integrally attached to the outer peripheral surface of the housing (10), the shield shell (30) having opposite ends spaced apart in a longitudinal direction (LD) and a cut (32) extending between the opposite ends, first and second edges (33A, 33B) at opposite sides of the cut (32), first and second opening preventing pieces (34A, 34B) extending from the respective first and second edges (33A, 33B) and at least partly facing one another, the first opening preventing piece (34A) being between the second opening preventing pieces (34B) and the second edge (33B) and the second opening preventing piece (34B) being between the first opening preventing piece (34A) and the first edge (33A), whereby the first and second opening preventing pieces (34A, 34B) are engageable with one another to limit displacement of the edges (33A, 33B) away from one another and the first and second opening preventing pieces (34A, 34B) being engageable respectively with the second and first edges (33B, 33A) to limit displacement of the edges (33B, 33A) toward one another.

11. The shield connector of claim 10, further comprising a first bulge (35A) projecting from the first edge (33A) toward the second edge (33B) and a second bulge (35B) projecting from the second edge (33B) toward the first edge (33A), the first and second opening preventing pieces (34A, 34B) being bent to stand out from the respective first and second bulges (35A, 35B).

12. The shield connector of claim 11, wherein the first opening preventing piece (34A, 34B) has a portion projecting back from the first bulge (35A) and being opposed to the second bulge (35B) and the second opening preventing piece (34B) has a portion projecting forward from the second bulge (35B) and being opposed to the first bulge (35A).

13. The shield connector of claim 12, wherein each of the first and second edges (33A, 33B) are formed respectively with first and second escaping recesses (36A, 36B), the first bulge (35A) being dimensioned and aligned for engaging in the second escaping recess (36B) and the second bulge (35B) being dimensioned and aligned for engagement in the first escaping recess (36A).

14. The shield connector of claim 13, wherein dimensions of the opening preventing pieces (34A, 34B) in the longitudinal direction (LD) are substantially equal to the dimensions of the escaping recesses (36A, 36B)) in the longitudinal direction (LD) and greater than dimensions of the bulges (35A, 35B)) in the longitudinal direction (LD).

15. The shield connector of claim 10, wherein the opening preventing pieces (34A, 33B) are embedded entirely in the housing (10).

* * * * *